US006006735A

United States Patent [19]

Schlough et al.

[11] Patent Number: 6,006,735

[45] Date of Patent: Dec. 28, 1999

[54] AUTOMATED STONEWORKING SYSTEM AND METHOD

[75] Inventors: Thomas L. Schlough, St. Cloud; Robert A. Penas, Silver Lake; James P. O'Connor, Cold Spring, all of Minn.

[73] Assignee: Park Industries, Inc., St. Cloud, Minn.

[21] Appl. No.: 08/928,380

[22] Filed: Sep. 12, 1997

[51] Int. Cl.[6] ..... B28D 1/04

[52] U.S. Cl. ..... 125/13.01; 451/5; 451/44; 451/57; 451/65

[58] Field of Search ..... 125/13.01; 451/5, 451/65, 44, 57

[56] References Cited

U.S. PATENT DOCUMENTS

| | | | |
|---|---|---|---|
| 4,436,078 | 3/1984 | Bourke | 125/13 R |
| 4,603,392 | 7/1986 | Chikamoto et al. | 364/475 |
| 4,685,180 | 8/1987 | Kitaya et al. | 29/33 R |
| 4,698,088 | 10/1987 | Bando | 65/174 |
| 5,040,342 | 8/1991 | McGuire et al. | 51/283 E |
| 5,313,743 | 5/1994 | Peschik | 51/266 |
| 5,396,736 | 3/1995 | Bando | 451/5 |
| 5,409,417 | 4/1995 | Bando | 451/9 |

*Primary Examiner*—Timothy V. Eley
*Assistant Examiner*—Dung Van Nguyen
*Attorney, Agent, or Firm*—Nikolia, Mersereau & Dietz, P.A.

[57] ABSTRACT

An automated stoneworking system and method for cutting and shaping various stone materials, such as marble and granite, in any number of preprogrammed fashions so as to eliminate the need for manual stoneworking operations.

61 Claims, 9 Drawing Sheets

AUTOMATED STONEWORKING SYSTEM AND METHOD

BACKGROUND OF THE INVENTION

I. Field of the Invention

The present invention relates generally to stoneworking, and, more particularly, to an automated stoneworking system and method for cutting and shaping various stone materials, such as marble, granite, and limestone, in any number of preprogrammed fashions so as to eliminate the need for manual stoneworking operations.

II. Discussion of the Prior Art

Stoneworking, in general, involves a host of cutting and shaping operations with the goal of producing finely crafted stone articles, such as marble or granite counter tops, table tops, and/or sink tops. In the past, manufacturers of such stone articles have been largely restricted to the use of manual techniques for accomplishing the desired stone cutting and/or shaping operations. For example, saws, routers, and similar hand-held devices have experienced widespread use for cutting and shaping stone articles to include any number of different edge configurations and/or apertures. While manual stoneworking techniques have been generally effective in crafting finely shaped stone articles, a multitude of significant drawbacks nonetheless exist which precipitate the need for the present invention.

A first notable drawback is that, by definition, an operator must physically control the particular hand-held stoneworking tool to perform the desired cutting and/or shaping operations. In that stone articles are typically quite hard in construction, such as marble or granite, it is typically quite time consuming and physically strenuous for the operator to direct the hand-held cutting and/or shaping devices about the stone article to accomplish the desired stoneworking operations. The time consuming nature of such manual stoneworking techniques effectively limits the production rate of such stone articles which, as will be appreciated, translates into a distinct disadvantage in the increasingly competitive marketplace. A related disadvantage is that manual stoneworking invariably results in a host of imperfections due to the fact that it is extremely difficult for an operator to follow a particular cutting/shaping path with a high degree of accuracy. Such cutting and/or shaping imperfections may decrease the commercial appeal of such products and/or increase the amount of such articles which must be scrapped, discarded, and/or reworked.

In light of the foregoing, it will be appreciated that a need exists for an automated stoneworking device and method for performing a variety of stone cutting and/or shaping operations in a minimal amount of time with little or no physical exertion on the part of an operator. A need furthermore exists for an automated stoneworking device and method capable of performing such stone cutting and/or shaping operations in a highly precise fashion so as to produce finely crafted stone articles which are free from any cutting or shaping imperfections.

SUMMARY OF THE INVENTION

It is accordingly a principal object of the present invention to provide an automated stoneworking device and method for performing a variety of stone cutting and/or shaping operations in a minimal amount of time with little or no physical exertion on the part of an operator.

It is yet another principal object of the present invention to provide an automated stoneworking device and method capable of performing stone cutting and/or shaping operations in a highly precise fashion so as to produce finely crafted stone articles which are free from any cutting or shaping imperfections.

In accordance with a broad aspect of the present invention, the foregoing objects are achieved by providing an automated stoneworking apparatus comprising cutting means, shaping means, transportation means, and processing means. The cutting means are provided for forming a cut-edge on a generally planar stone article. The shaping means are provided for shaping the cut-edge of said stone article. The transportation means are provided for selectively transporting the cutting means and the shaping means relative to the stone article. The processing means are communicatively coupled to the cutting means, the shaping means, and the transportation means for selectively directing the cutting means, the shaping means, and the transportation means to automatically cut and shape the stone article along a predetermined travel path.

In accordance with yet another broad aspect of the present invention, the foregoing objects are achieved by providing an automated stoneworking apparatus for producing a predetermined edge configuration on a generally planar stone article. The automated stoneworking apparatus comprises cutting means for selectively cutting the stone article, grinding means for selectively grinding the stone article, and means for selectively engaging the cutting means and the grinding means with the stone article to produce a predetermined edge configuration on the stone article.

In accordance with still a further broad aspect of the present invention, the foregoing objects are achieved by providing a method of automatically producing a predetermined edge configuration on a generally planar stone article, comprising the steps of: (a) providing an automated stoneworking apparatus including cutting means for forming a cut-edge on a generally planar stone article, shaping means for shaping the cut-edge of the stone article, transportation means for selectively transporting the cutting means and the shaping means relative to the stone article, and processing means communicatively coupled to the cutting means, the shaping means, and the transportation means for selectively directing the cutting means, the shaping means, and the transportation means; and (b) programming the processing means to selectively direct the cutting means, the shaping means, and the transportation means to produce a predetermined edge configuration on the stone article.

The foregoing features and advantages of the present invention will be readily apparent to those skilled in the art from a review of the following detailed description of the preferred embodiment in conjunction with the accompanying drawings and claims.

DETAILED DESCRIPTION OF THE PREFERRED EMBODIMENTS

Figure 1:
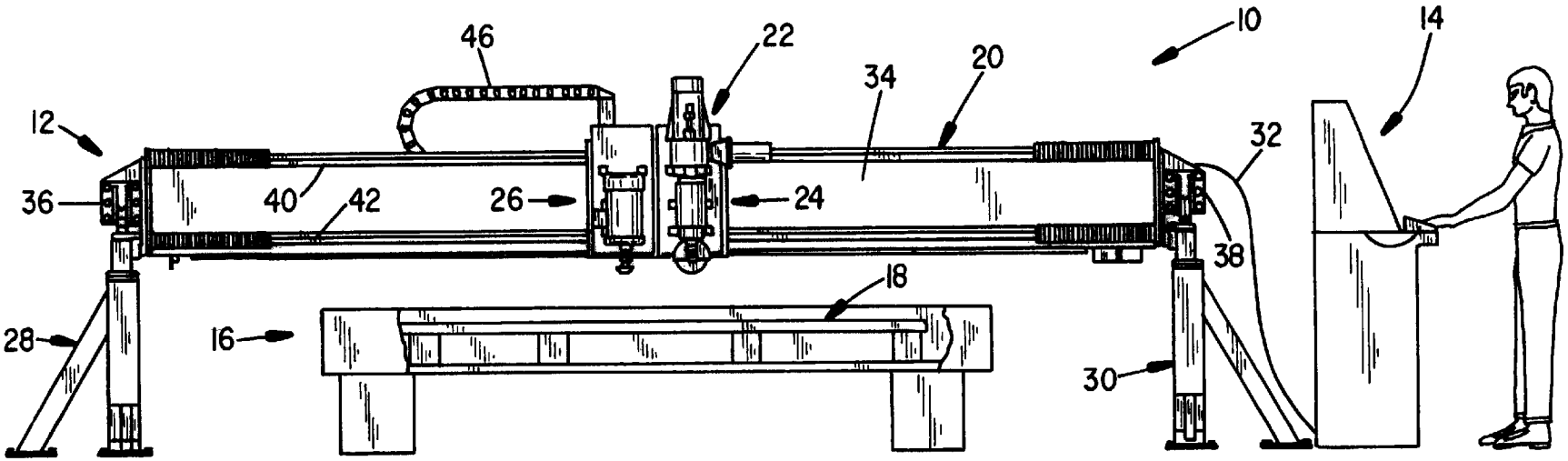
FIG. 1 is a side elevational view of an automated stoneworking system 10 of the present invention, including an automated stoneworking assembly 12, a control station 14, and a work table 16 having a generally planar article of stone 18 disposed thereon.
Figure 2:
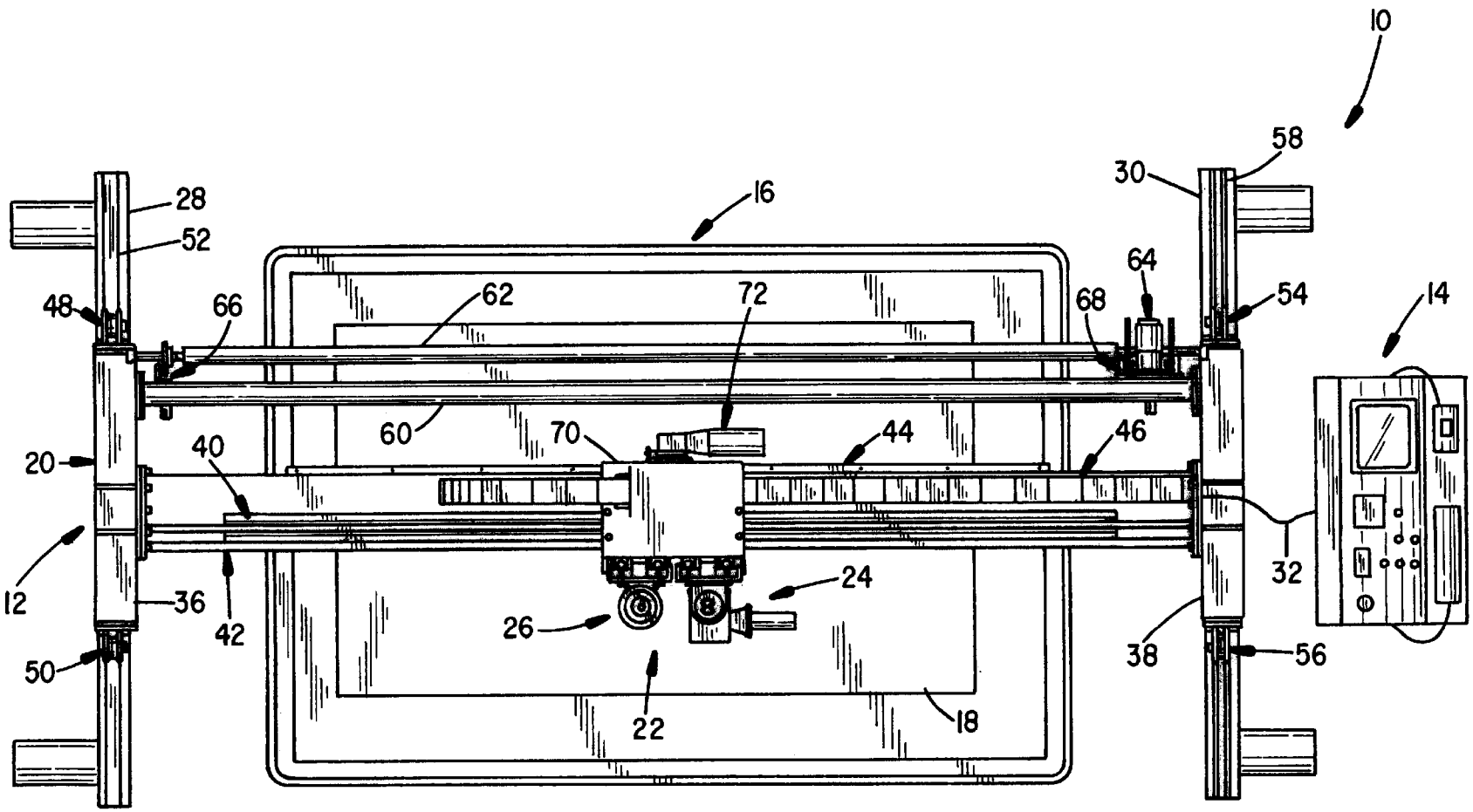
FIG. 2 is a top elevational view of the automated stoneworking system 10 shown in FIG. 1.

Referring initially to FIGS. 1 and 2, shown is an automated stoneworking system 10 constructed in accordance with a preferred embodiment of the present invention. The automated stoneworking system 10 includes an automated stoneworking assembly 12, a control station 14, and a work table 16 for restraining a stone article 18 proximate to the stoneworking assembly 12 during stoneworking operations. The automated stoneworking assembly 12 includes a gantry assembly 20, a cross travel assembly 22, a stone cutting assembly 24, and a stone shaping assembly 26. The stone cutting assembly 24 and the stone shaping assembly 26 are coupled to the cross travel assembly 22 and provided with vertical translation means for selectively raising and lowering the stone cutting assembly 24 and the stone shaping assembly 26 relative to the stone article 18. The cross travel assembly 22 is slidably coupled to the gantry assembly 20 and equipped with transverse translation means for selectively moving the cross travel assembly 22 transversely back and forth relative to the stone article 18. The gantry assembly 20 is slidably disposed on a first support member 28 and a second support member 30 and equipped with lateral translation means for selectively moving the cross travel assembly 22 laterally back and forth relative to the stone article 18. As will be set forth in greater detail below, the control station 14 includes a host of input/output devices for operator control, and an internally disposed microprocessor controller (not shown) having memory means and control means. The memory means is provided for storing data representing any number of predetermined edge configurations. The control means is communicatively coupled to the stoneworking assembly 12 via line 32 for selectively controlling the stoneworking assembly 12 to create any number of predetermined edge configurations on the stone article 18. As used herein, the term "edge configuration" includes the path an edge takes along or within the stone article 18, i.e. an oval or circular aperture formed in the stone article 18, as well as the particular shape of the edge, i.e. beveled or flat. In a preferred embodiment, the automated stoneworking system 10 is advantageously capable of automatically shaping the stone article 18 to generate aesthetically pleasing and high precision stone fixtures, such as sink tops, counter tops, and table tops.

The gantry assembly 20 of the present invention includes a cross beam member 34, a first buttress member 36 fixedly attached to a first end of the cross beam member 34, and a second buttress member 38 fixedly attached to a second end of the cross beam member 34. The cross beam member 34 is generally square in cross section and includes a first slide rail 40, a second slide rail 42, and a gear rail 44. As will be set forth in greater detail below, the cross travel assembly 22 includes transverse translation means and a plurality of slide blocks which cooperate with the gear rail 44 and the first and second slide rails 40, 42 such that the cross travel assembly 22 may be selectively translated back and forth along the cross beam member 34 under the direction of the control station 14. The electrical communication between the control station 14 and the stoneworking assembly 12 is provided via a cable bundle 32 which, in a preferred embodiment, extends within a segmented housing member 46 for protection during use. The first and second buttress members 36, 38 are slidably disposed on top of the first and second support members 28, 30, respectively. In a preferred embodiment, this is accomplished by providing the first buttress member 36 with a first flat roller assembly 48 and a second flat roller assembly 50 for traveling back and forth along a flat rail 52 on the first support member 28. The second buttress member 38, on the other hand, is provided with a first grooved roller assembly 54 and a second grooved roller assembly 56 for traveling back and forth along a grooved rail member 58 on the second support member 30. The lateral translation means for moving the gantry assembly 20 back and forth along first and second support members 28, 30 includes a cross support member 60, a rotatable drive member 62, and a motor 64. The cross support member 60 is fixedly attached to the first and second buttress members 36, 38 and includes a first coupling member 66 and a second coupling member 68 for rotatably supporting the drive member 62. The second coupling member 68 is further configured to support the motor 64 in an engaged fashion with the drive member 62. Although not shown, the terminal ends of the drive member 62 have engagement portions, such as gear assemblies, which cooperate with corresponding engagement portions within the first and second buttress members 36, 38. In this arrangement, the gantry assembly 20 may be selectively translated laterally back and forth along the first and second support members 28, 30 by selectively operating the motor 64 which, in a preferred embodiment, is directed via the control station 14.

Figure 3:
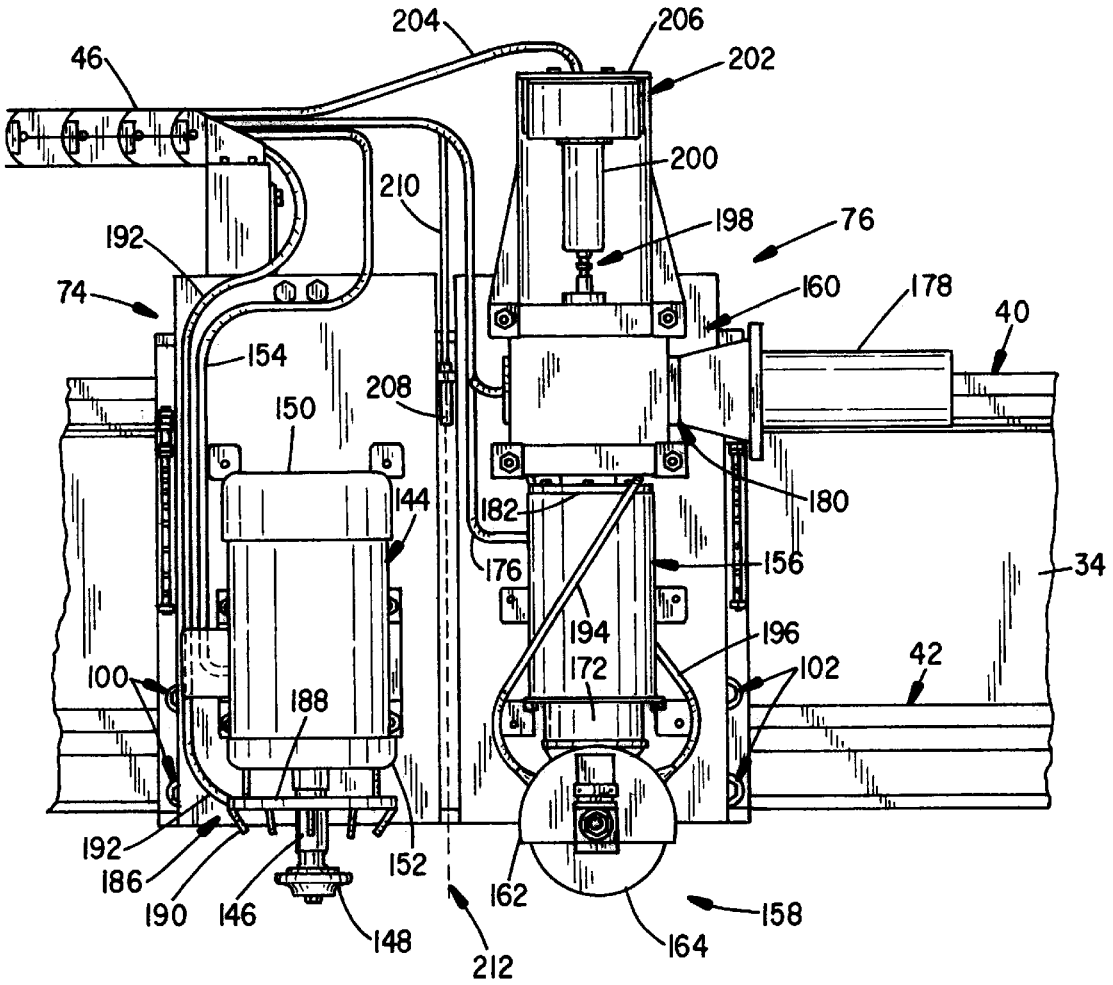
FIG. 3 is an enlarged front elevational view of a cross travel assembly 22 of the present invention having a stone cutting assembly 24 and stone shaping assembly 26 coupled thereto.
Figure 4:
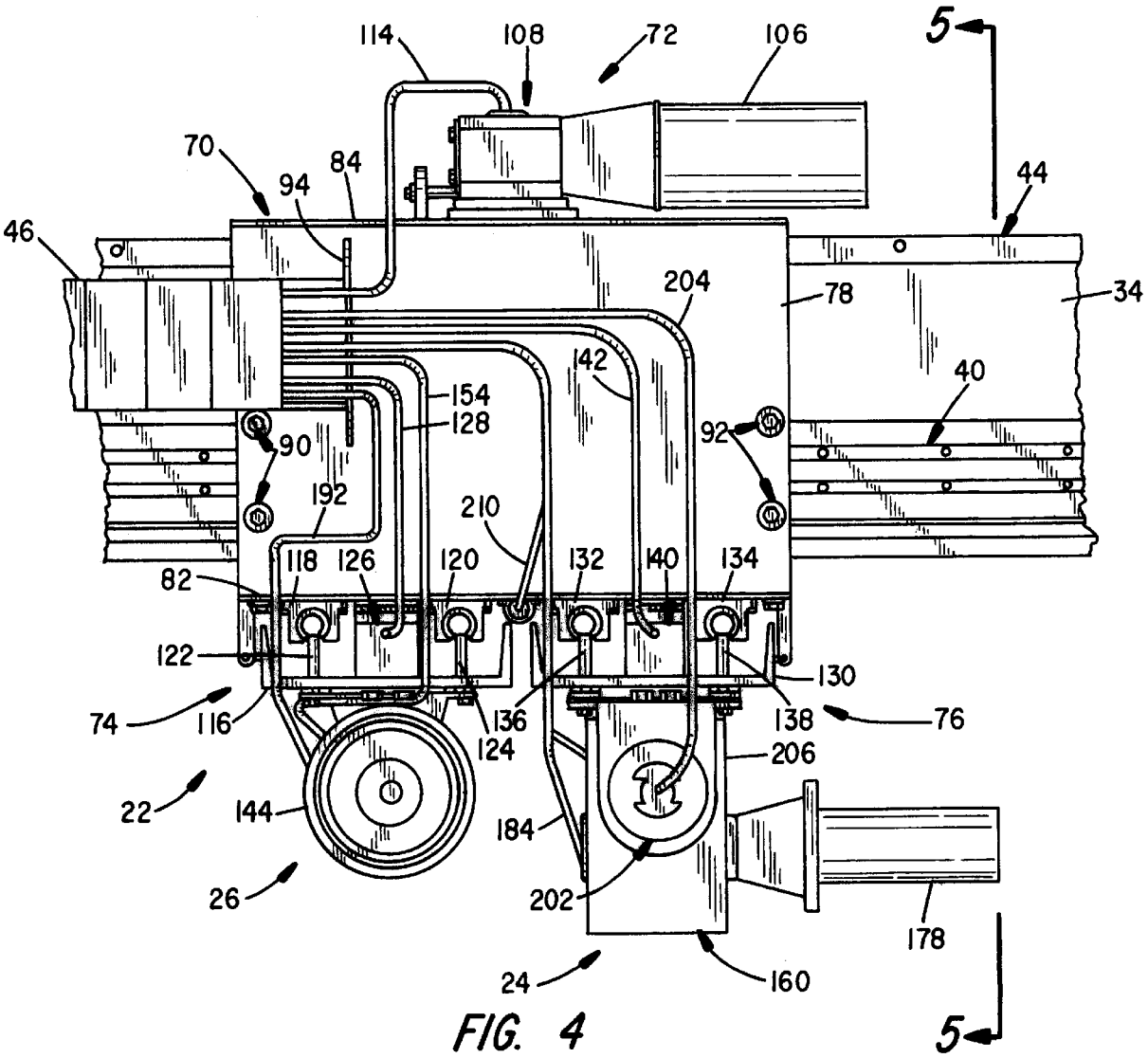
FIG. 4 is a top view of the cross travel assembly 22 shown in FIG. 3.
Figure 5:
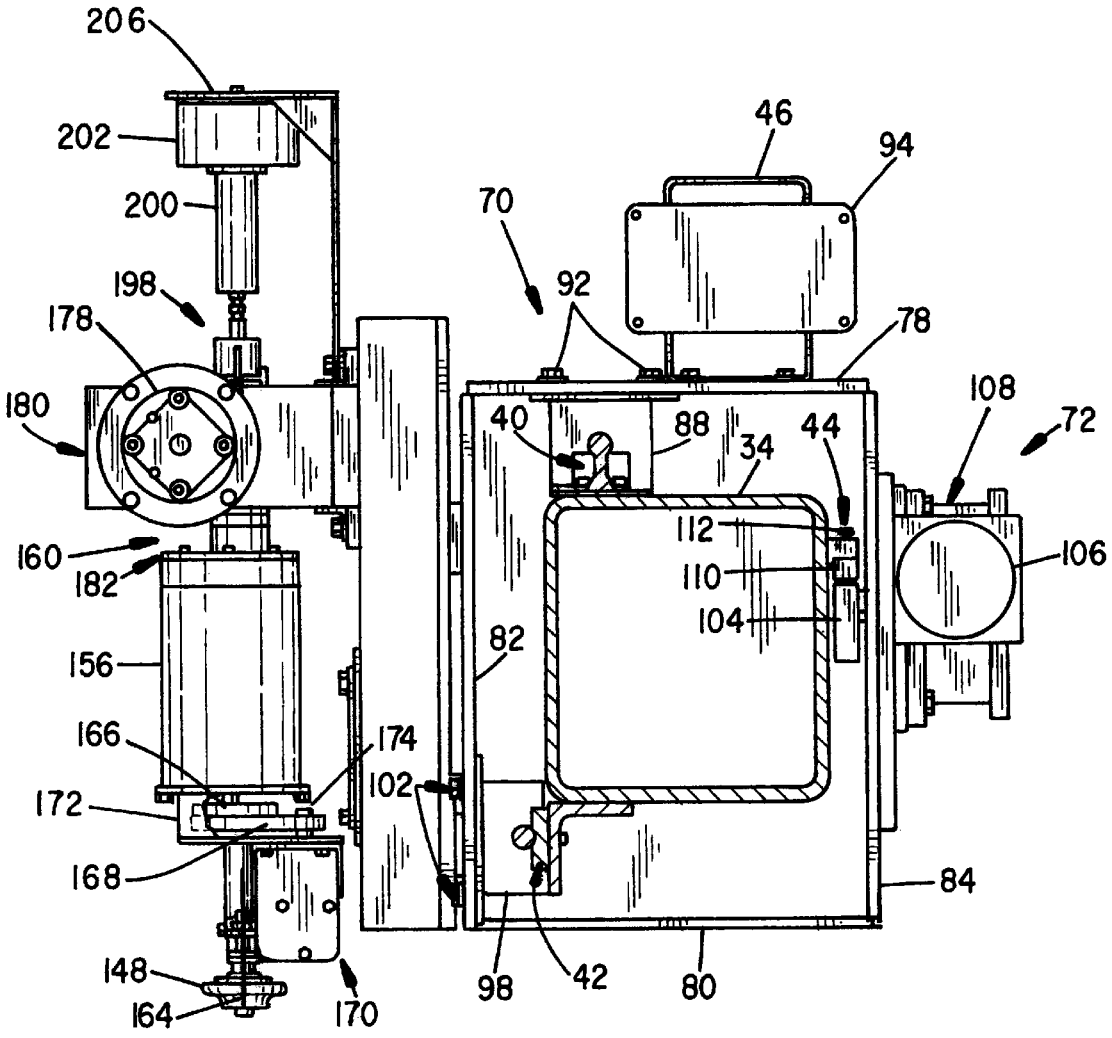
FIG. 5 is a partial sectional view of the cross travel assembly 22 taken through lines 5—5 in FIG. 4.

With reference now to FIGS. 3–5, the cross travel assembly 22 includes a cross travel body 70, a transverse translation assembly 72 for selectively translating the cross travel body 70 back and forth along the cross beam member 34, a first vertical translation assembly 74 for slidably coupling the stone shaping assembly 26 to the cross travel body 70, and a second vertical translation assembly 76 for slidably coupling the stone cutting assembly 24 to the cross travel body 70. The cross travel body 70 includes a top plate member 78, a bottom plate member 80, a front plate member 82, a rear plate member 84. The top plate member 78 includes a first and second slide blocks 88 only one of which can be seen in FIG. 5. It is identified by numeral 88 and the pair of aligned slide blocks are fixedly attached along the underside of top plate 78 via bolts 90, 92, respectively, for slidably receiving the first slide rail 40 on the cross beam member 34. The top plate member 78 also includes a mount plate 94 for fixedly attaching the segmented cable housing 46 to the cross travel body 70. The front plate member 82 includes third and fourth slide blocks of which only slide block 98 is visible in FIG. 5. The slide blocks are fixedly attached along the interior surface thereof via bolts as at 102, for slidably receiving the second slide rail 42 on the cross beam member 34. The transverse translation assembly 72 includes a motor 106 cooperatively operable with a coupling assembly 108 attached to the rear plate member 84 of the cross travel body 70. The coupling assembly 108 includes a rotatable gear member 104 extending within the cross travel body 70 which engages with an elongated gear member 110 fixedly attached beneath the gear rail 44 via bolts 112. In this fashion, the cross travel body 70 may be selectively translated back and forth along the cross beam member 34 by selectively operating the motor 106. The motor 106 is communicatively linked to the control station 14 via a line 114 such that the operation of the motor 106 and, hence, the direction and speed of the cross travel body 70, may be controlled via the control station 14.

The first vertical translation assembly 74 includes a mount plate 116, a first slide block 118, a second slide block 120, a first slide rail 122, a second slide rail 124, and an actuator 126. The stone shaping assembly 26 may be coupled to the mount plate 116 via any number of different fastening means, such as bolts. The first and second slide rails 122, 124 are fixedly attached to the mount plate 116 via bolts and are slidably received within the first and second slide blocks 118, 120, respectively. The actuator 126 is coupled to the mount plate 116 via bolts and communicatively linked to the control station 14 via a line 128 such that the stone shaping assembly 26 may be selectively raised and lowered by selectively activating the actuator 126. The second vertical translation assembly 76 is constructed in the same fashion, including a mount plate 130, a third slide block 132, a fourth slide block 134, a third slide rail 136, a fourth slide rail 138, and an actuator 140. The stone cutting assembly 24 is fixedly coupled to the mount plate 130 via, for example, bolts. The third and fourth slide blocks 132, 134 are fixedly coupled to the front plate 82 of the cross travel body 70. The third and fourth slide rails 136, 138 are fixedly attached to the mount plate 130 via bolts and are slidably received within the third and fourth slide blocks 132, 134, respectively. The actuator 140 is fixedly coupled to the mount plate 130 via bolts. The actuator 140 is communicatively coupled to the control station 14 via a line 142 such that the actuator 140 may be selectively operated to raise and lower the stone cutting assembly 24. In a preferred embodiment, the actuators 126, 140 are pneumatically operated. It is to be understood, however, that providing the actuators 126, 140 as pneumatic is set forth by way of example and not limitation such that the actuators 126, 140 may comprise any number of motors or actuators, such as an hydraulic actuator or solenoid, without departing from the scope of the present invention.

The stone shaping assembly 26 includes a motor 144 having a rotating spindle member 146 extending therefrom, and a shaping tool 148 disposed at the distal end of the rotating spindle member 146. The motor 144 is fixedly coupled to the mount plate 116 of the first vertical translation assembly 74 via an upper motor mount 150 and a lower motor mount 152. The motor 144 is communicatively linked to the control station 14 via a line 154 such that the motor 144 may be selectively operated to rotate the spindle member 146 and the shaping tool 148 over a wide range of speeds. In a preferred embodiment, the motor 144 is a five (5) horsepower motor capable of rotating the spindle member 146 and the attached shaping tool 148 at speeds ranging from 500 to 5,000 RPM. It is to be readily understood, however, that the motor 144 may comprise any number of different motor types, having a wide variety of operating ranges, without departing from the present invention. The shaping tool 148 may also comprise any number of commercially available shaping tools, including but not limited to diamond segmented and/or diamond plated shaping tools. It is furthermore to be understood that, although the shaping tool 148 is shown having a curved profile for producing beveled edges on the stone article 18, the shaping tool 148 may take any number of different profiles, such as flat or angular, for shaping the edges of the stone article 18 in any number of different fashions.

The stone cutting assembly 24 includes a motor 156, a blade assembly 158, and a pivot assembly 160 extending between the motor 156 and the mount plate 130 of the second vertical translation assembly 76. The blade assembly 158 includes a blade cover 162 and a circular blade member 164 disposed rotatably therewithin. The motor 156 includes a rotating drive member 166 which is cooperatively coupled to the blade member 164 via a belt 168 and gear assembly 170. A shield member 172 is preferably provided for enclosing the operation of the rotatable drive member 166 of the motor 156 and the belt member 168. The shield member 172 is shown partially cut-away in FIG. 5, however, to clearly illustrate the cooperative engagement of the drive member 166, the belt 168, and a gear member 174 extending from the gear assembly 170. The motor 156 is communicatively linked to the control station 14 via a line 176 and may comprise any number of fixed speed or variable speed motors for rotating the blade member 164 at a predetermined fixed speed or over a wide range of speeds, respectively. In a preferred embodiment, for example, the motor 156 may be a one and one-half (1½) horsepower fixed speed motor capable of rotating the blade member 164 at a speed of 3600 RPM. As with the motor 144 of the stone shaping assembly 26, it is to be readily understood any number of different motor sizes and types may be substituted for the motor 156 without departing from the present invention. In an important aspect of the present invention, the pivot assembly 160 provides the ability to selectively rotate the motor 156 and blade assembly 158 up to 360 degrees about the longitudinal axis of the motor 156. To accomplish this rotation, the pivot assembly 160 includes a motor 178, a low backlash gear drive system 180, and a mount plate 182 for attaching the motor 156 to the gear drive system 180. The motor 156 and the gear drive system 180 are communicatively linked to the control station 14 via lines 176, 184, respectively, such that they may be selectively operated to pivot the motor 156 and blade member 164 up to 360 degrees about the longitudinal axis of the motor 156. In a preferred embodiment, the motor 178 may comprise one of any number of commercially available servo motors capable of forcefully pivoting the blade member 164 through the stone article 18. It is to be readily understood that the motor 178 may also be provided as any number of different types of motors other than a servo motor without departing from the present invention. In a preferred embodiment, the blade member 164 may comprise any number of commercially available side cutting blades. Such blades may be diamond segmented and/or diamond plated.

In a preferred embodiment, fluid supply means are provided on the stone cutting assembly 24 and the stone shaping assembly 26 for irrigating the stone article 18 during cutting and shaping operations to remove slurry and provide a cooling function for the blade member 164 and the shaping tool 148. Providing fluid in this fashion also minimizes the degree to which the shaping tool 148 and blade 164 experience glazing or become otherwise damaged during use. The fluid supply means associated with the shaping tool 148, for example, includes a first fluid supply assembly 186 for directing fluid, such as water, toward the shaping tool 148 during shaping operations. In a preferred embodiment, the first fluid supply assembly 186 includes a hollow ring member 188 having a plurality of nozzles 190. The ring member 188 is fixedly attached to the lower motor mount 152 and equipped to receive a hose member 192 which extends from the segmented cable housing 46 for transporting fluid from a fluid reservoir (not shown) to the nozzles 190. The hollow ring member 188 is disposed circumferentially about the shaping tool 148 such that the nozzles 190 are directed generally at the shaping tool 148. In order to minimize unwanted spray, a flexible splash guard or cuff may be further provided surrounding the hollow ring member 188 to decrease the incidence of spray deflecting in an undesirable fashion during such irrigation operations.

The fluid supply means associated with the stone cutting assembly 24 includes a second fluid hose 194 and a third fluid hose 196 connected to the blade cover 162 so as to direct fluid, such as water, toward the blade member 164 for the purpose of eliminating slurry from the cutting area and cooling the blade member 164. The second and third fluid hoses 194, 196 extend in a generally spiral fashion along the sides of the motor 156 for connection to a main fluid coupling 198 disposed above the gear drive assembly 160. The main fluid coupling 198 is further connected to a rigid conduit member 200 which extends for connection to a rotatable hose carrier member 202. The hose carrier member 202 is coupled to a fluid hose 204 extending from the segmented cable housing 46. In an important aspect, the hose carrier member 202 is rotatably coupled to a hose carrier mount 206 such that the fluid hose 204 will not be twisted or rotated about itself when the motor 156 of the stone cutting assembly 24 is pivotally rotated via the motor 178 of the pivot assembly 160. Rather, the rotatable nature of the hose carrier member 202 allows the fluid hose 204 from the segmented cable housing 46 to remain disposed in the same approximate position during the pivoting of the motor 156 such that the fluid hose 204 will be able to supply fluid to the rigid conduit member 200 and ultimately to the second and third hose members 194, 196 without fear of becoming tangled or otherwise fouled.

In a preferred embodiment, the cross travel assembly 22 also includes a laser assembly 208 disposed on the cross travel body 70 in between the first and second vertical translation assemblies 74, 76. As will be explained in greater detail below, the laser assembly 208 is communicatively linked to the control station 14 via line 210 and capable of projecting a laser beam, designated generally with dashed lines at 212, downward onto the stone article 18 within the work table 16. The laser assembly 208 provides a visual indication to the user as to the position of the cross travel assembly 22 relative to the subject stone article 18. In an important aspect of the present invention, the sighting feature accomplished by the laser assembly 208 allows an operator to selectively direct the cross travel assembly 22 and the gantry assembly 20 to trace a predetermined pattern disposed on the stone article 18. In conjunction with digitizing software within the microprocessor controller of the control station 14, the pattern may be digitized and stored in memory within the control station 14 for subsequent retrieval. Thereafter, the digitized parameters may be selectively employed to automatically direct and control the stoneworking assembly 12 to produce any number of different edge configurations on the stone article 18 within the work table 16.

Figure 6A:
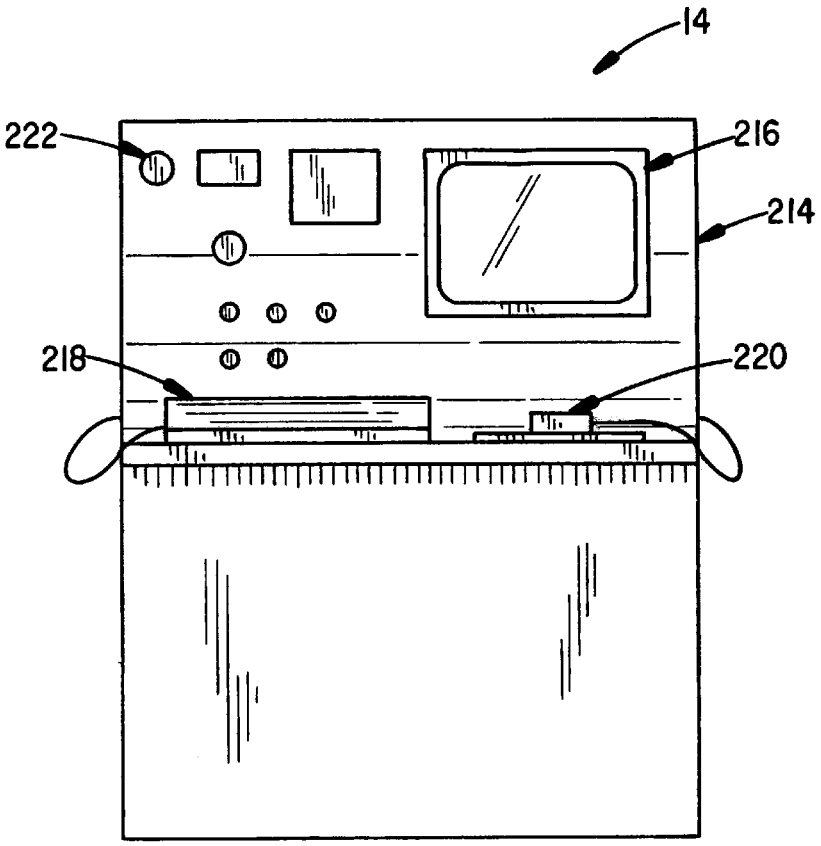
FIG. 6A is a front elevational view of an exemplary embodiment of the control station 14.
Figure 6B:
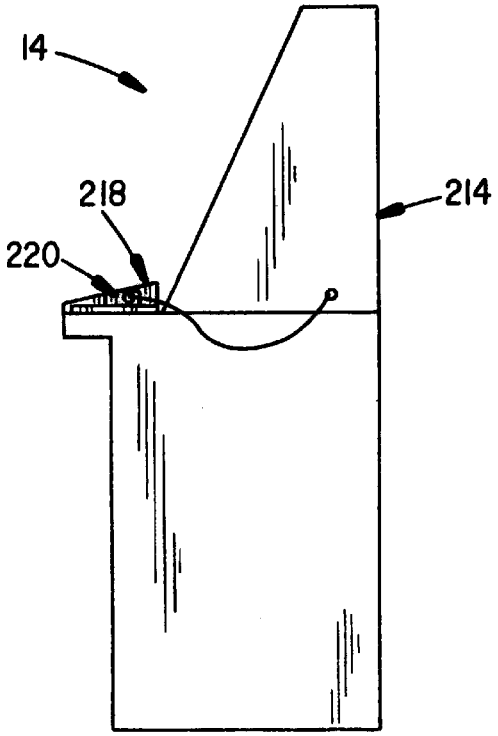
FIG. 6B is a side elevational view of the control station 14 as shown in FIG. 6A.

FIGS. 6A and 6B illustrate the control station 14 provided in accordance with a preferred embodiment of the present invention. The control station 14 may take the form of a kiosk or similar free standing housing 214 and include any of a variety of data input/output devices for allowing an operator to manage and direct the operation of the stoneworking assembly 12. For example, such data input/output devices may include, but are not necessarily limited to, a screen display 216 for visually communicating information to the operator, a keyboard 218 and/or a computer mouse 220 for communicating data and responses from the operator to the microprocessor controller (not shown), and an on/off button 222 for activating and deactivating the control station 14 and stoneworking assembly 12. The microprocessor controller (not shown) is programmed to coordinate a dialog with the operator to determine a desired stoneworking operation and carry out the same.

In an important aspect of the present invention, the desired stoneworking operation may involve effectuating one of a plurality of preprogrammed and/or custom edge configurations on the stone article 18. To effectuate a preprogrammed edge configuration, the operator must first select a particular preprogrammed edge configuration from the memory means of the microprocessor controller (not shown) and thereafter follow a series of instructional prompts on the screen display 216 to carry out the desired stoneworking operation. Due to the preprogramming, the operator may perform all necessary control actions via the control station 14. To effectuate a custom edge configuration, the operator must first define the custom edge configuration on the stone article 18 and thereafter digitize this information for storage in the memory means of the microprocessor controller (not shown) for use in controlling the stoneworking assembly 12.

Figure 7A:
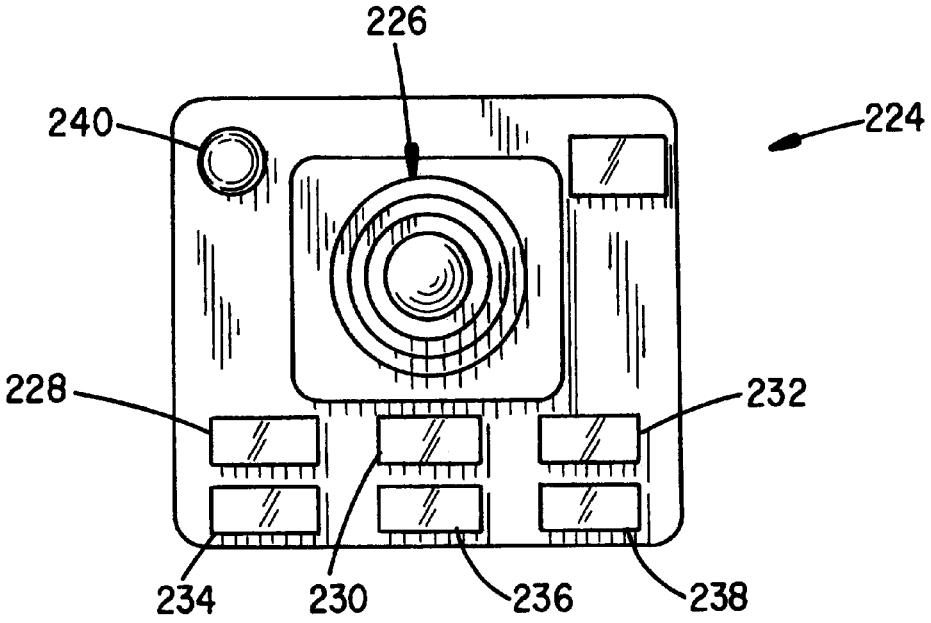
FIG. 7A is a top elevational view of a hand-held control pendant 224 provided in accordance with a preferred embodiment of the present invention.
Figure 7B:
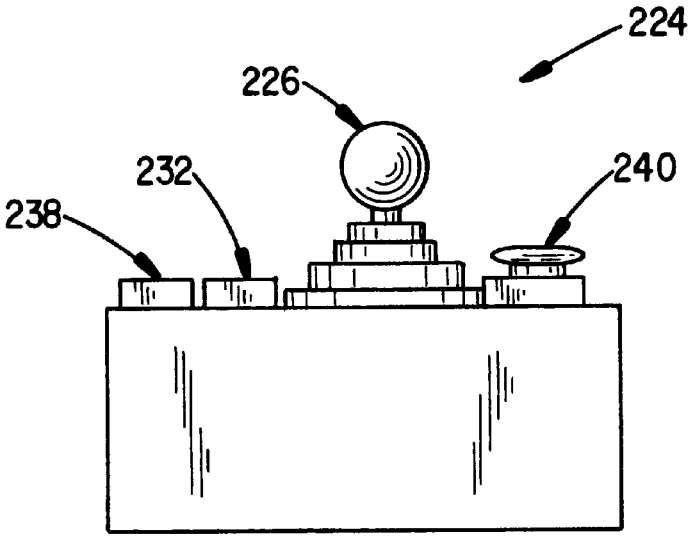
FIG. 7B is a side elevational view of the control pendant 224 shown in FIG. 7A.

With reference to FIGS. 7A and 7B, the tasks of defining and digitizing a custom edge configuration on the stone article 18 are, in a preferred embodiment, accomplished through the use of a hand-held control pendant 224. The hand-held control pendant 224 is communicatively coupled to the control station 14 and provides a host of control functions such that the operator may carry it about the work table 16 while defining and digitizing a custom edge configuration on the stone article 18. As will be set forth in greater detail below, the process of defining a custom edge configuration typically starts by positioning a full scale pattern, such as a plastic, wood, cardboard, or cloth cut-out, on the stone article 18. The hand-held control pendant 224 may then be employed in conjunction with the laser assembly 208 to trace the outline of the pattern as disposed on the stone article 18. The travel path of the laser assembly 208 is then digitized during the tracing of the pattern and recorded in the memory means of the microprocessor controller (not shown) for subsequent use in directing the stoneworking assembly 12. In a preferred embodiment, the control pendant 224 accomplishes this by providing a toggle assembly 226, a "line" button 228, a "CW ARC" button 230, a "CCW ARC" button 232, a "cut on/off" button 234, an "undo" button 236, a "return" button 238, an emergency override button 240, and a "low speed" button 242, all of which allow an operator to direct the operation of the stoneworking assembly 12 while disposed away from the control station 14. The toggle assembly 226 is provided for directing the stoneworking assembly 12 and, more particularly, the laser assembly 208 about the stone article 18. The "line" button 228 is provided for indicating to the microprocessor controller (not shown) the end of a straight line on the stone article 18. The "CW ARC" button 230 is provided for indicating to the microprocessor controller (not shown) the mid-point and end of a clockwise arc on the stone article 18. The "CCW ARC" button 232 is provided for indicating to the microprocessor controller (not shown) the mid-point and end of a counter-clockwise arc on the stone article 18. The "cut on/off" button 234 is provided for activating and deactivating the stoneworking assembly 12. The "undo" button 236 is provided for erasing a previously digitized section of the pattern from the memory means of the microprocessor controller (not shown). The "return" button 238 is provided for directing the stoneworking assembly 12 to return to a previously marked position on the stone article 18. The emergency override button 240 is provided for immediately stopping the stoneworking assembly 12. The "low speed" button 242 is provided for selectively placing the stoneworking assembly 12 in a low speed mode.

Figure 8:
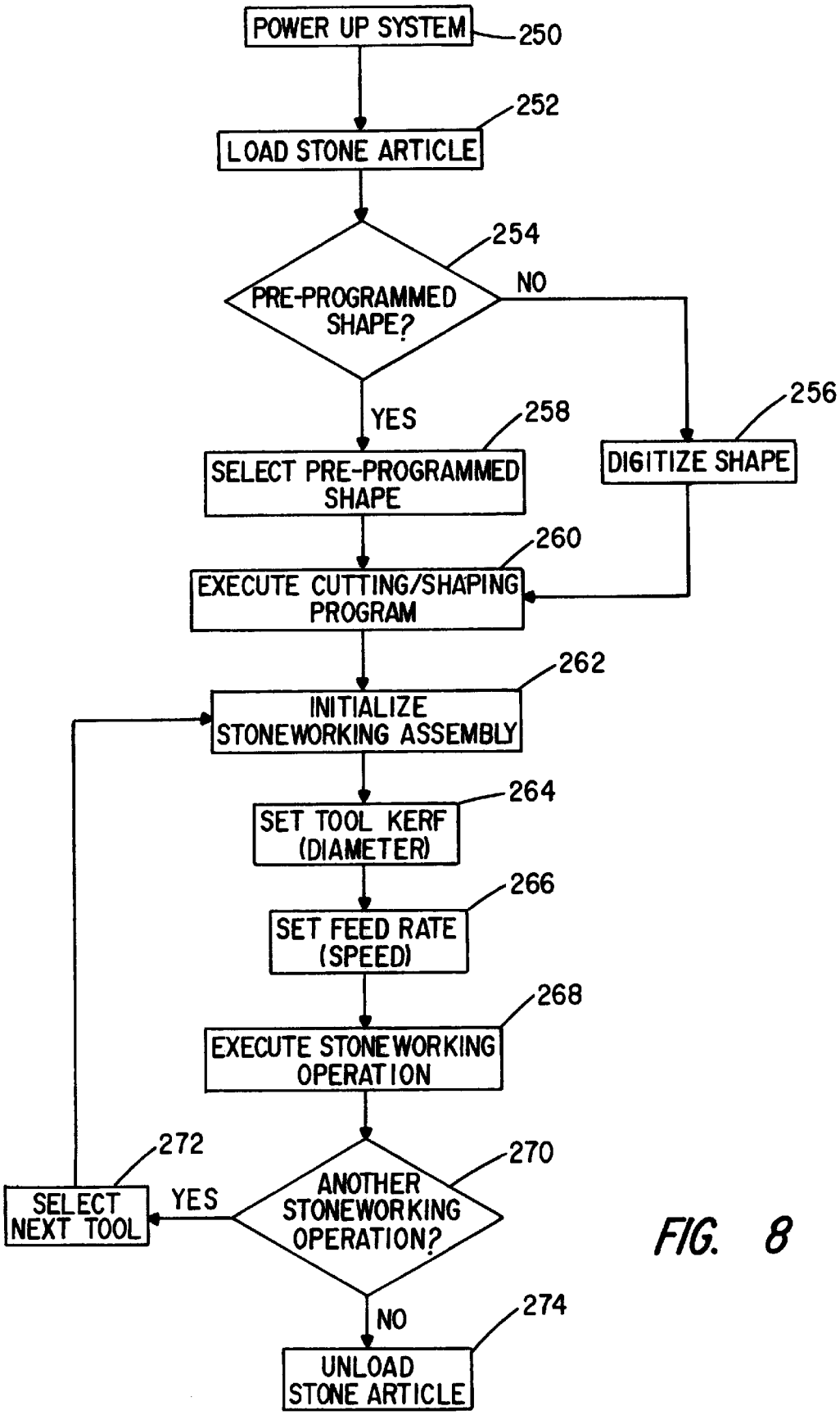
FIG. 8 is a flow diagram illustrating the operational steps of the automated stoneworking system 10 of the present invention.

FIG. 8 is a flow chart illustrating the various steps involved in operating the automated stoneworking system 10 of the present invention. The first step 250 entails powering up the automated stoneworking system 10 which, in a preferred embodiment, may be accomplished via the on/off switch 222 on the control station 14. The stone article 18 is then loaded into the work table 16 in step 252 to prepare the stoneworking system 10 for operation. A decision is then posed in step 254 as to whether the operator wishes to proceed with a pre-programmed shape or edge configuration. If the operator does not wish to proceed with a pre-programmed edge configuration, then the operator must digitize a custom shape or edge configuration in step 256, the details of which will be described below with reference to FIG. 9. If the operator does desire to fashion the stone article 18 according to a pre-programmed shape, then the operator must, in step 258, select a pre-programmed shape or edge configuration from a library of pre-programmed shapes stored within the memory means of the microprocessor controller (not shown). To facilitate this, the microprocessor controller (not shown) may be programmed to provide a graphical representation of a particular edge configuration on the screen display 216 for selection or inspection by the operator and/or instructions to direct or request input on the part of the operator.

A cutting/shaping software program within the microprocessor controller (not shown) is then executed in step 260 so as to form the stone article 18 pursuant to one of the pre-programmed shape selected in step 258 and the custom digitized shape generated in step 256. In a preferred embodiment, the stoneworking assembly 12 is then initialized in step 262 so as to position the stoneworking assembly 12 in a home location with known coordinates. In order to assure proper cutting and/or shaping operations, the diameter or kerf of the stoneworking tool must then be set by the operator in step 264. This may be accomplished via the various data input/output devices on the control station 14, such as the keyboard 218 and/or computer mouse 220. The feed rate must then be set in step 266 for directing the speed at which the stoneworking assembly 12 effectuates the shape or edge configuration selected in step 256 or step 258. The desired stoneworking operation is then executed in step 268 which, in a preferred embodiment, involves controlling the stoneworking assembly 12 according to the information specified in steps 256–266. Following the execution of the selected stoneworking operation, a question is then posed in step 270 as to whether another stoneworking operation is desired. If another stoneworking operation is desired, the operator must then select the next stoneworking tool in step 272. In a preferred embodiment, the next stoneworking tool selected in step 272 will typically comprise the stone shaping tool 148 for shaping the cut edge provided by the blade member 164 of the stone cutting assembly 24. It is to be fully appreciated, however, that any number of different blade members may be interchanged in step 272 depending upon the desired stoneworking operation. In the instance that another stoneworking operation is desired, the stoneworking assembly 12 is once again initialized in step 262 after the next stoneworking tool is selected in step 272. This repeating sequence is continued until such time that there are no other stoneworking operations which the operator wishes to perform. In this instance, the finished stone article 18 may then be unloaded from the work table 16 in step 274.

Figure 9:
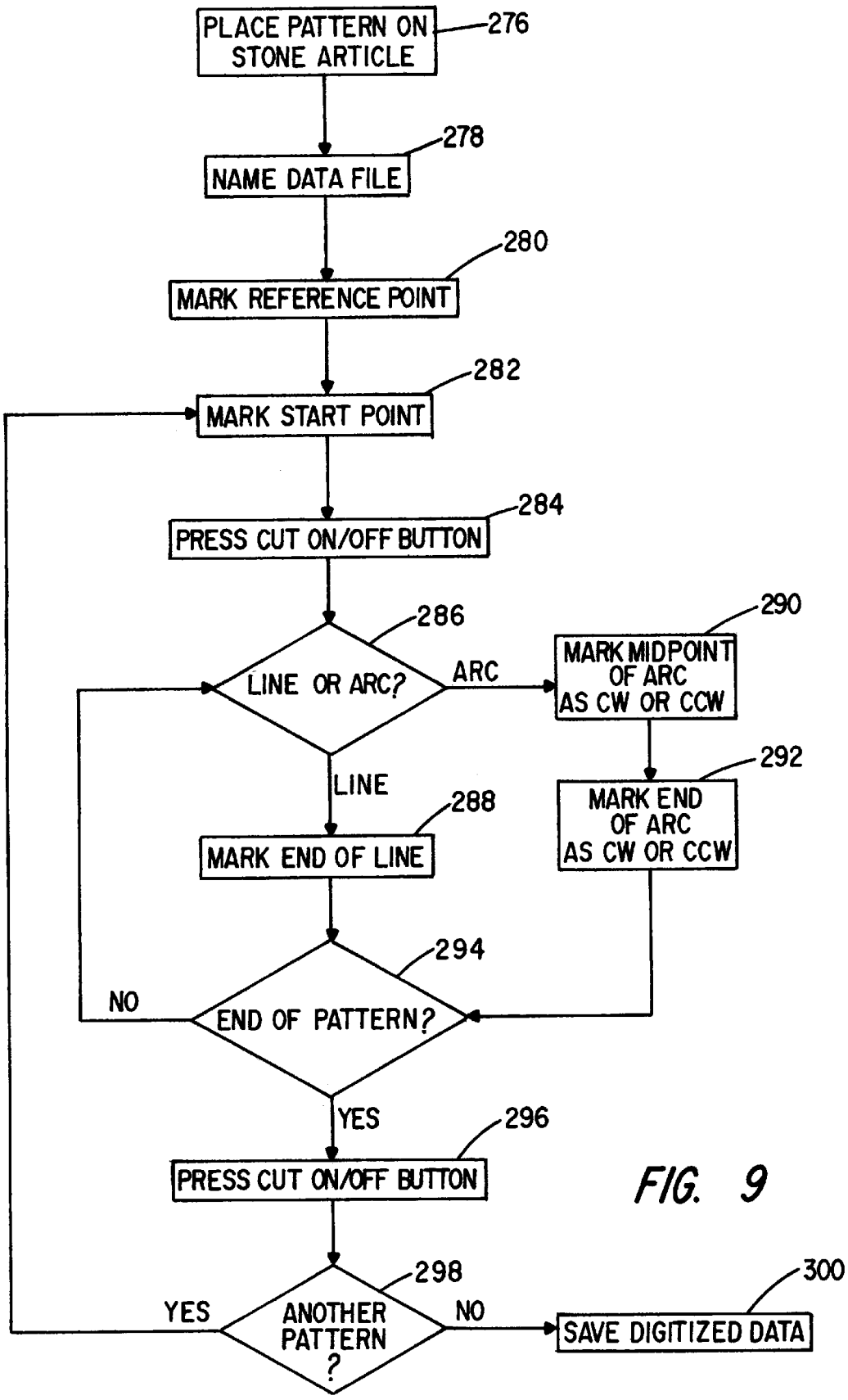
FIG. 9 is a flow diagram illustrating the operational steps involved in digitizing a custom pattern on the stone article 18.

FIG. 9 illustrates the various sub-steps involved in the step 256 of digitizing a custom shape on the stone article 18. The first step 276 involves placing a full-size pattern on the upper surface of the stone article 18. The pattern may be constructed from any number of different materials, such as paper, cardboard, wood, cloth, plastic and/or metal. Moreover, in an important aspect of the present invention, the pattern may take the form of any number of different or custom shapes and sizes so as to produce corresponding shapes or edge configurations on the stone article 18 in the work table 16. For purposes of data storage and retrieval, a data file is then named in step 278 for storing the edge configuration data created during the step 256 of digitizing a custom pattern on the stone article 18. A reference point is then established in step 280 for the purpose of creating a known coordinate on the pattern from which all digitized coordinates will be measured. In a preferred embodiment, the reference point in step 280 is created via the use of the control pendant 224. More specifically, the reference point may be created by directing the stoneworking assembly 12 to a selected position on the stone article 18 via the toggle assembly 226 and thereafter instructing the microprocessor controller (not shown) to record the coordinates for that particular position. Following the creation of a reference point, the start point of the particular custom pattern is then designated in step 282. Designating the start point in this fashion may also be accomplished through the use of the control pendant 224. Namely, the toggle assembly 226 may be employed to direct the stoneworking assembly 12 to a particular spot. The "line" button 228 must thereafter be activated to record the coordinates to define the start point of the custom shape. After the start point is defined, the operator must press the "cut on/off" button 234 on the control pendant 224 to begin documenting the cut line for the custom shape or pattern.

A query is posed in step 286 wherein the operator must decide whether the first portion of the custom shape comprises an arc or a straight line. If the first portion of the custom shape comprises a line, the end of the line must then be marked in step 288. In a preferred embodiment, the operator may perform step 288 by manipulating the toggle assembly 226 of the control pendant 224 such that the laser beam 212 moves along the desired line. Thereafter, the end of the line may be marked by simply depressing the "line" button 228 on the control pendant 224. If, on the other hand, an arc is desired as the first portion of the custom shape, then the midpoint of the arc must be marked as clockwise or counter clockwise in step 290. This, once again, may be accomplished by manipulating the toggle assembly 226 such that the laser beam 212 generated by the laser assembly 208 is generally positioned at the midpoint of the desired arc. The operator must then designate the orientation of the arc by selectively pressing the "CW ARC" button 230 for creating a clockwise arc or the "CCW ARC" button 232 for creating a counter clockwise arc. After the midpoint of the arc is marked in step 290, the operator must in step 292 mark the end of the arc as either clockwise or counter clockwise. As with step 290, the end of the desired arc may be marked in step 292 by first employing the toggle assembly 226 of the control pendant 224 and thereafter pressing either the "CW ARC" button 230 or "CCW ARC" button 232. Following the marking of the end of the line or arc, a question is posed in step 294 as to whether the previously marked line or arc is the end of the custom pattern. If there are further portions to the custom pattern, then the query in step 286 is once again encountered to determine whether the next portion of the custom pattern comprises a line or an arc. The aforementioned steps (186-294) continue until such time that there are no further portions (lines and/or arcs) in the custom pattern. The "cut on/off" button 234 is thereafter pressed by the operator to indicate to the microprocessor controller (not shown) that the digitizing of the custom pattern has been completed. The operator is thereafter questioned in step 298 as to whether another custom pattern is to be digitized. If so, the process returns to step 282 for marking the start point of the next custom pattern and continuing with the entire operational flow for the new custom pattern. If there are no further patterns to digitize, then the digitized data is saved within the data file established in step 278 for the purpose of subsequent retrieval.

In an important aspect of the present invention, the digitized edge configuration data generated by the process of FIG. 9 may be communicated back into and employed within the process set forth in FIG. 8. More specifically, the digitized edge configuration data from step 256 is communicated to the cutting/shaping program set forth in step 260. The step of initializing the stoneworking assembly 12 involves moving the stoneworking assembly 12 until the laser beam 212 is positioned in the same approximate location as the reference point marked in step 280 of FIG. 9. The tool kerf and feed rate are thereafter set in steps 264, 266 before executing the customized stoneworking operation in step 268. In a typical application, conducting step 268 will first involve effectuating a cut along the stone article 18 according to the edge configuration data generated in steps 276–300. By way of example and not limitation, this cutting function may establish a peripheral edge of a table top or a sink top, as well an internally disposed aperture such as that found in a sink. In an important aspect of the present invention, the stoneworking operation generated in step 268 is identical in shape and size to the custom pattern positioned on the stone article 18 in step 176. Thereafter, an operator may designate or select a particular edge shape for the previously generated cut in the stone article 18 via steps 270 and 272. For example, the operator may wish to shape the previously generated cuts in the stone article 18 in a beveled or angular fashion.

In view of the foregoing, it will be appreciated that the automated stoneworking system 10 of the present invention solves the various drawbacks in the prior art. The automated stoneworking system 10 is capable of generating any number of aesthetically pleasing and high precision stone fixtures, such as sink tops, counter tops, and table tops, in quick fashion without the need for exhaustive and imprecise manual stoneworking operations. This maximizes the quality of the finished stone articles 18 and furthermore increases the overall throughput by conducting the stoneworking operations to be conducted in a matter of minutes as opposed to hours. The present invention also removes the need for manual stoneworking operations, thereby decreasing the likelihood of injury or exhaustion. The automated stoneworking system 10 of the present invention furthermore offers great flexibility in fashioning stone articles by allows an operator to select from any of a variety of pre, programmed patterns or edge configurations, as well as generate custom patterns via digitization. In all cases, the automated stoneworking system 10 is capable of performing stone cutting and/or shaping operations in a highly precise fashion to produce finely crafted stone articles which are free from any cutting or shaping imperfections.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself For example, in a preferred embodiment, the motors 64, 72 178 may comprise any number of commercially available brushless servo motors. However, it is to be understood that a wide variety of motors may be employed in this capacity without departing from the scope of the present invention. Moreover, although the first and second buttress members 36, 38 are shown having flat roller assemblies 48, 50 and grooved roller assemblies 54, 56, respectively, it is to be fully understood that any number of sliding mechanisms may be employed for transporting the gantry assembly 20 in the lateral direction without departing from the scope of the present invention. It is also to be readily apparent that the first and second support members 28, 30 may be replaced by similar support means or removed altogether without departing from the scope of the invention.

Furthermore, the first fluid assembly 186 associated with the stone shaping assembly 26 may take any number of different shapes and forms without departing from the scope of the present invention. For example, a greater number or fewer number of nozzle portions 190 may be provided so long as the first fluid supply assembly 186 is capable of directing sufficient amounts of fluid generally toward the shaping tool 148 to effectively remove slurry and/or cool the shaping tool 148 during use. In similar fashion, the irrigation system associated with the stone cutting assembly 24 may take any number of different shapes and forms without departing from the scope of the present invention. For example, a greater number or fewer number of hoses may be coupled to the blade cover 162 so long as sufficient amounts of fluid are delivered to the blade member 164 to effectively remove slurry and/or cool the blade member 164 during use.

What is claimed is:

1. A automated stoneworking apparatus, comprising:

(a) cutting means for forming a cut-edge on a generally planar stone article of a predetermined thickness dimension;

(b) shaping means for shaping said cut-edge of said stone article;

(c) transportation means for selectively transporting said cutting means and said shaping means along three mutually perpendicular axes relative to said stone article, said stone article remaining stationary; and (d) processing means communicatively coupled to said cutting means, said shaping means, and said transportation means for selectively directing said cutting means, said shaping means, and said transportation means to automatically cut and shape said stone article along a predetermined travel path and through the predetermined thickness dimension thereof.

2. The automated stoneworking apparatus as set forth in claim 1 and further, said processing means including memory means for storing data defining said predetermined travel path, and control means for selectively controlling said cutting means, said shaping means, and said transportation means to cut and shape said stone article along said predetermined travel path.

3. The automated stoneworking apparatus as set forth in claim 2 and further, said processing means including data input means for selectively storing in said data storage means data defining said predetermined travel path.

4. The automated stoneworking apparatus as set forth in claim 3 and further, said data input means including means for selectively digitizing a pattern on said stone article to obtain said data defining said predetermined travel path.

5. The automated stoneworking apparatus as set forth in claim 4 and further, said means for selectively digitizing including coordinate detection means for detecting a location on said stone article and communication means for communicating data representing said location to said data storage means, said coordinate detection means being cooperatively operable with said transportation means such that coordinate detection means may trace said pattern such that said communication means can communicate to said data storage means data representing said pattern.

6. The automated stoneworking apparatus as set forth in claim 1 and further, said transportation means including a first travel means for moving said cutting means and said shaping means in a first plane, a second travel means slidably coupled to said first travel means for moving said cutting means and said shaping means in a second plane, and third travel means for moving said cutting means and said shaping means in a third plane.

7. The automated stoneworking apparatus as set forth in claim 6 and further, said first travel means including a gantry assembly and first motor means for selectively moving said gantry assembly in said first plane.

8. The automated stoneworking apparatus as set forth in claim 7 and further, said gantry assembly including a cross beam member, a first buttress member fixedly attached to a first end of said cross beam member, and a second buttress member fixedly attached to a second end of said cross beam member, wherein said buttress members are slidably disposed in said first plane and first motor means is configured to selectively translate said buttress members in said first plane.

9. The automated stoneworking apparatus as set forth in claim 8 and further, said first buttress member having first roller means slidably disposed along a generally flat rail member and said second buttress member having second roller means slidably disposed along a generally grooved rail member, wherein said first roller means cooperates with said flat rail member and said second roller cooperates with said grooved rail member to accurately guide said gantry assembly in said first plane.

10. The automated stoneworking apparatus as set forth in claim 6 and further, said second travel means including a cross travel assembly slidably coupled to said first travel assembly and second motor means for selectively moving said cross travel assembly relative to said first travel assembly in said second plane.

11. The automated stoneworking apparatus as set forth in claim 10 and further, said third travel means being slidably disposed on said cross travel assembly of said second travel means.

12. The automated stoneworking apparatus as set forth in claim 11 and further, said third travel means including a first translation assembly for selectively moving said cutting means in said third plane and a second translation assembly for selectively moving said shaping means in said third plane.

13. The automated stoneworking apparatus as set forth in claim 12 and farther, said first translation assembly including a first mount plate, first slide means extending between said first mount plate and said cross travel assembly of said second travel means, and first actuation means for selectively sliding said first mount plate via said first slide means, wherein said cutting means is fixedly coupled to said first mount plate such that said first actuation means may selectively move said cutting means in said third plane.

14. The automated stoneworking apparatus as set forth in claim 13 and further, said second translation assembly including a second mount plate, second slide means extending between said second mount plate and said cross travel assembly of said second travel means, and second actuation means for selectively sliding said second mount plate via said second slide means, wherein said shaping means is fixedly coupled to said second mount plate such that said second actuation means may selectively move said shaping means in said third plane.

15. The automated stoneworking apparatus as set forth in claim 6 and further, said cutting means including a blade assembly and pivot means for selectively pivoting said blade assembly up to three hundred sixty (360) degrees about an axis of said third plane to produce said cut-edge in said stone article as one of a straight line and a curved radius.

16. The automated stoneworking apparatus as set forth in claim 15 and further, said blade assembly including a blade member and blade motor means for selectively operating said blade member to generate said cut-edge in said stone article.

17. The automated stoneworking apparatus as set forth in claim 16 and further, said blade assembly including a blade housing for pivotally containing said blade member, said pivot means including a spindle member rigidly attached to said blade housing and pivot motor means capable of capable of selectively pivoting said blade housing via said spindle member up to three hundred and sixty (360) degrees about said axis of said third plane.

18. The automated stoneworking apparatus as set forth in claim 1 and further, said shaping means including a shaping tool and shaping motor means for selectively operating said shaping tool to shape said cut-edge formed along said stone article by said cutting means.

19. The automated stoneworking apparatus as set forth in claim 18 and further, said shaping means including a spindle member coupled to said shaping motor means for coupling said shaping tool to said shaping motor means.

20. The automated stoneworking apparatus as set forth in claim 19 and further, said shaping tool comprising a grinding member for grinding said stone article along said cut-edge to produce a shaped-edge on said stone article.

21. The automated stoneworking apparatus as set forth in claim 20 and further, said grinding member having a generally angled configuration for producing said shaped-edge as generally angular.

22. The automated stoneworking apparatus as set forth in claim 20 and further, said grinding member having a generally planar configuration for producing said shaped-edge as generally planar.

23. The automated stoneworking apparatus as set forth in claim 20 and further, said grinding member having a generally curved configuration for producing said shaped-edge as generally curved.

24. The automated stoneworking apparatus as set forth in claim 1 and further, including fluid supply means for selectively providing a supply of fluid toward one of said cutting means and said shaping means during operation.

25. The automated stoneworking apparatus as set forth in claim 24 and further, said fluid supply means including first fluid supply means for directing a supply of fluid toward said cutting means during operation, and second fluid supply means for directing a supply of fluid toward said shaping means during operation.

26. The automated stoneworking apparatus as set forth in claim 25 and further, said first fluid supply means including a fluid reservoir, pump means for selectively pumping fluid from said fluid reservoir, at least one fluid nozzle directed generally at said cutting means, and fluid transmission means extending between said pump means and said at least one fluid nozzle for transmitting a pressurized supply of fluid from said fluid reservoir to said at least one fluid nozzle.

27. The automated stoneworking apparatus as set forth in claim 26 and further, said second fluid supply means including a fluid reservoir, pump means for selectively pumping fluid from said fluid reservoir, at least one fluid nozzle directed generally at said shaping means, and fluid transmission means extending between said pump means and said at least one fluid nozzle for transmitting fluid from said pump means to said at least one fluid nozzle.

28. An automated stoneworking apparatus for producing a predetermined edge configuration on a generally planar stone article of a predetermined thickness dimension, comprising:

(a) cutting means having a stone cutting blade assembly for selectively cutting said stone article along a predetermined path and through the thickness dimension of the stone article to create an edge surface;

(b) grinding leans for selectively grinding said stone article over said edge surface; and (c) means for selectively engaging said cutting means and said grinding means along three mutually perpendicular axes relative to with said stone article to produce a predetermined edge configuration on said stone article over the entire thickness dimension thereof.

29. The automated stoneworking apparatus as set forth in claim 28 and further, said means for selectively engaging including transportation means for selectively transporting said cutting means and said grinding means relative to said stone article.

30. The automated stoneworking apparatus as set forth in claim 29 and further, said means for selectively engaging including processing means communicatively coupled to said cutting means, said grinding means, and said transportation means for selectively directing said cutting means, said grinding means, and said transportation means to automatically form said predetermined edge configuration on said stone article.

31. The automated stoneworking apparatus as set forth in claim 30 and further, said processing means including memory means, data input means communicatively coupled to said memory means for selectively storing in said memory means data representing said predetermined edge configuration, and control means for selectively controlling said cutting means, said grinding means, and said transportation means based on said data to automatically form said predetermined edge configuration on said stone article.

32. The automated stoneworking apparatus as set forth in claim 31 and further, said data input means including digitizing means for selectively digitizing a pattern on said stone article to obtain travel path data representing a travel path for said cutting means and said grinding means to follow to produce said predetermined edge configuration.

33. The automated stoneworking apparatus as set forth in claim 32 and further, said digitizing means including tracing means for tracing said pattern as positioned on said stone article, coordinate detection means for detecting coordinates during said tracing of said pattern, and communication means for communicating data representing said coordinates to said memory means.

34. The automated stoneworking apparatus as set forth in claim 33, said tracing means comprising light projection means for selectively projecting a tracing light beam onto said stone article, said light projection means being cooperatively operable with said transportation means for directing said tracing light beam along said pattern to define said travel path for producing said predetermined edge configuration.

35. The automated stoneworking apparatus as set forth in claim 34 and further, said light projection means comprising a laser device.

36. The automated stoneworking apparatus as set forth in claim 29 and further, said transportation means including first travel means for moving said cutting means and said grinding means in a first plane, second travel means slidably coupled to said first travel member for moving said cutting means and said grinding means in a second plane, and third travel means for moving said cutting means and said grinding means in a third plane.

37. The automated stoneworking apparatus as set forth in claim 36 and further, said first travel means including a gantry assembly and first motor means for selectively moving said gantry assembly in said first plane.

38. The automated stoneworking apparatus as set forth in claim 37 and further, said gantry assembly including a cross beam member, a first buttress member fixedly attached to a first end of said cross beam member, and a second buttress member fixedly attached to a second end of said cross beam member, wherein said buttress members are slidably disposed in said first plane and first motor means is configured to selectively translate said buttress members in said first plane.

39. The automated stoneworking apparatus as set forth in claim 38 and further, said first buttress member having first roller means slidably disposed along a generally flat rail member and said second buttress member having second roller means slidably disposed along a generally grooved rail member, wherein said first roller means cooperates with said flat rail member and said second roller cooperates with said grooved rail member to accurately guide said gantry assembly in said first plane.

40. The automated stoneworking apparatus as set forth in claim 36 and further, said second travel means including a cross travel assembly slidably coupled to said first travel assembly and second motor means for selectively moving said cross travel assembly relative to said first travel assembly in said second plane.

41. The automated stoneworking apparatus as set forth in claim 40 and further, said third travel means being slidably disposed on said cross travel assembly of said second travel means.

42. The automated stoneworking apparatus as set forth in claim 41 and further, said third travel means including a first translation assembly for selectively moving said cutting means in said third plane and a second translation assembly for selectively moving said grinding means in said third plane.

43. The automated stoneworking apparatus as set forth in claim 42 and further, said first translation assembly including a first mount plate, first slide means extending between said first mount plate and said cross travel assembly of said second travel means, and first actuation means for selectively sliding said first mount plate via said first slide means, wherein said cutting means is fixedly coupled to said first mount plate such that said first actuation means may selectively move said cutting means in said third plane.

44. The automated stoneworking apparatus as set forth in claim 43 and further, said second translation assembly including a second mount plate, second slide means extending between said second mount plate and said cross travel assembly of said second travel means, and second actuation means for selectively sliding said second mount plate via said second slide means, wherein said grinding means is fixedly coupled to said second mount plate such that said second actuation means may selectively move said grinding means in said third plane.

45. The automated stoneworking apparatus as set forth in claim 28 and further, said cutting means includes a pivot means for selectively pivoting said blade assembly up to three hundred sixty (360) degrees about an axis of said third plane to produce a cut-edge in said stone article as one of a straight line and a curved radius.

46. The automated stoneworking apparatus as set forth in claim 45 and further, said blade assembly including a blade member and blade motor means for selectively operating said blade member to generate said cut-edge in said stone article.

47. The automated stoneworking apparatus as set forth in claim 46 and further, said blade assembly including a blade housing for pivotally containing said blade member, said pivot means including a spindle member rigidly attached to said blade housing and pivot motor means capable of capable of selectively pivoting said blade housing via said spindle member up to three hundred and sixty (360) degrees about said axis of said third plane.

48. The automated stoneworking apparatus as set forth in claim 28 and further, said grinding means including a grinding tool and motor means for selectively engaging said grinding tool along said cut-edge of said stone article to form a shaped-edge.

49. The automated stoneworking apparatus as set forth in claim 48 and further, said grinding means including a spindle member coupled to said motor means for coupling said grinding tool to said motor means.

50. The automated stoneworking apparatus as set forth in claim 49 and further, said grinding member having a generally angled configuration for producing said shaped-edge as generally angular.

51. The automated stoneworking apparatus as set forth in claim 49 and further, said grinding member having a generally planar configuration for producing said shaped-edge as generally planar.

52. The automated stoneworking apparatus as set forth in claim 49 and further, said grinding member having a generally curved configuration for producing said shaped-edge as generally curved.

53. The automated stoneworking apparatus as set forth in claim 28 and further, including fluid supply means for selectively providing a supply of fluid toward one of said cutting means and said shaping means during operation.

54. The automated stoneworking apparatus as set forth in claim 53 and further, said fluid supply means including first fluid supply means for directing a supply of fluid toward said cutting means during operation, and second fluid supply means for directing a supply of fluid toward said shaping means during operation.

55. The automated stoneworking apparatus as set forth in claim 54 and further, said first fluid supply means including a fluid reservoir, pump means for selectively pumping fluid from said fluid reservoir, at least one fluid nozzle directed generally at said cutting means, and fluid transmission means extending between said pump means and said at least one fluid nozzle for transmitting a pressurized supply of fluid from said fluid reservoir to said at least one fluid nozzle.

56. The automated stoneworking apparatus as set forth in claim 55 and further, said second fluid supply means including a fluid reservoir, pump means for selectively pumping fluid from said fluid reservoir, at least one fluid nozzle directed generally at said shaping means, and fluid transmission means extending between said pump means and said at least one fluid nozzle for transmitting fluid from said pump means to said at least one fluid nozzle.

57. A method of automatically producing a predetermined edge configuration on a generally planar stone article of a predetermined thickness, comprising the steps of:

(a) providing an automated stoneworking apparatus including cutting means having a cutting blade for sawing through the thickness of said generally planar stone article creating a cut-edge, shaping means for shaping said cut-edge of said stone article, transportation means for selectively transporting said cutting means and said shaping means in directions alone three mutually perpendicular axes relative to said stone article, and processing means communicatively coupled to said cutting means, said shaping means, and said transportation means for selectively directing said cutting means, said shaping means, and said transportation means; and (b) programming said processing means to selectively direct said cutting means, said shaping means, and said transportation means to produce a predetermined edge configuration on said stone article while said stone article remains stationary.

58. The method as set forth in claim 57 and further, step (a) comprising the further sub-steps of:

(i) providing said processing means having memory means for storing data;

(ii) providing said processing means having control means for controlling said cutting means, said shaping means, and said transportation means; and (iii) providing data input means for selectively storing in said memory means data defining a predetermined travel path to accomplish said predetermined edge configuration.

59. The method as set forth in claim 58 and further, step (b) comprising the further substep of operating said data input means to store in said memory means data defining said predetermined travel path to accomplish said predetermined edge configuration.

60. The method as set forth in claim 59 and further, step (b) comprising the further sub-step of digitizing a pattern on said stone article to obtain said data defining said predetermined travel path.

61. The method as set forth in claim 59 and further, step (b) comprising the further sub-step of storing in said memory means a plurality of programs for generating a plurality of predetermined edge configurations on said stone article.

* * * * *